US012808571B2

(12) United States Patent
Kanematsu

(10) Patent No.: US 12,808,571 B2
(45) Date of Patent: Nov. 24, 2026

(54) DECORATIVE PANEL AND EMBEDDED VENTILATION FAN INCLUDING THE SAME

(71) Applicant: Panasonic Intellectual Property Management Co., Ltd., Osaka (JP)

(72) Inventor: Daisuke Kanematsu, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 392 days.

(21) Appl. No.: 18/610,061

(22) Filed: Mar. 19, 2024

(65) Prior Publication Data

US 2024/0328663 A1 Oct. 3, 2024

(30) Foreign Application Priority Data

Mar. 27, 2023 (JP) ..... 2023-049313

(51) Int. Cl.
*F24F 13/08* (2006.01)
*F24F 7/007* (2006.01)

(52) U.S. Cl.
CPC ..... *F24F 13/084* (2013.01); *F24F 7/007* (2013.01)

(58) Field of Classification Search
CPC ..... F24F 1/0047; F24F 1/0053; F24F 1/0011; F24F 1/64; F24F 13/20; F24F 13/082; F24F 13/084; F24F 13/068; F24F 7/007; F24F 7/10
See application file for complete search history.

(56) References Cited

U.S. PATENT DOCUMENTS

2019/0338984 A1* 11/2019 Fang ..... E06B 7/082
2021/0164681 A1* 6/2021 Coleman, Jr. ..... F24F 13/082
2021/0302060 A1* 9/2021 Chang ..... F24F 7/02
2022/0163229 A1* 5/2022 Liu ..... F24F 13/08
2023/0288094 A1* 9/2023 Zhou ..... F24F 13/084

FOREIGN PATENT DOCUMENTS

JP 07260243 A * 10/1995
JP 2004340438 A * 12/2004
JP 04314879 B2 8/2009

* cited by examiner

*Primary Examiner* — Ko-Wei Lin
(74) *Attorney, Agent, or Firm* — Renner, Otto, Boisselle & Sklar LLP

(57) ABSTRACT

A decorative panel includes a front surface, a rear surface, a grille opening, a frame portion, and an air supply grille. The grille opening is surrounded by the frame portion, and the air supply grille includes an air supply slit, an air supply slit opening, an outer air supply blowing unit, and a contact portion. The air supply grille is detachably provided in the grille opening, and air is supplied from a rear surface side to a front surface side through the air supply slit opening. The outer air supply blowing unit forms a passage of the air supplied from the air supply slit opening, and the air supply grille is attached to the grille opening by bringing an upper surface of the frame portion into contact with a lower surface of the contact portion.

5 Claims, 10 Drawing Sheets

DECORATIVE PANEL AND EMBEDDED VENTILATION FAN INCLUDING THE SAME

BACKGROUND

1. Technical Field

The present disclosure relates to a decorative panel.

2. Description of the Related Art

In a decorative panel of the related art, a configuration in which an air supply grille is attached to a grille opening is known.

In addition, in an embedded ventilation fan of the related art, a configuration in which the decorative panel (design louver) is provided on a lower surface of a housing is known.

CITATION LIST

Patent Literature

PTL 1: Japanese Patent No. 4314879

SUMMARY

In the decorative panel of the related art described above, there has been a problem that the air supply grille may fall from the grille opening in a case where aged deterioration occurs around the grille opening or in the air supply grille.

The present disclosure has been made to solve the above problem of the related art, and an object of the present disclosure is to provide a decorative panel in which an air supply grille is less likely to fall from a grille opening.

In order to achieve this object, a decorative panel according to an aspect of the present disclosure includes a front surface, a rear surface, a grille opening, a frame portion, and an air supply grille. The front surface is a surface opposite to the rear surface, the grille opening is surrounded by the frame portion, the air supply grille includes an air supply slit, an air supply slit opening, an outer air supply blowing unit, and a contact portion, the air supply grille is detachably provided in the grille opening, the air supply slit forms the air supply slit opening, air is supplied from the rear surface side to the front surface side through the air supply slit opening, the outer air supply blowing unit forms a passage of the air supplied from the air supply slit opening, the contact portion is connected to the outer air supply blowing unit, and when the front surface side is defined as a down direction and the rear surface side is defined as an up direction, the air supply grille is attached to the grille opening by bringing an upper surface of the frame portion into contact with a lower surface of the contact portion.

According to the present disclosure, it is possible to suppress the falling of the air supply grille from the grille opening.

DETAILED DESCRIPTIONS

Hereinafter, an exemplary embodiment of the present disclosure will be described with reference to the drawings.

First Exemplary Embodiment

First, a basic configuration of embedded ventilation fan 1 will be described.

Figure 1:
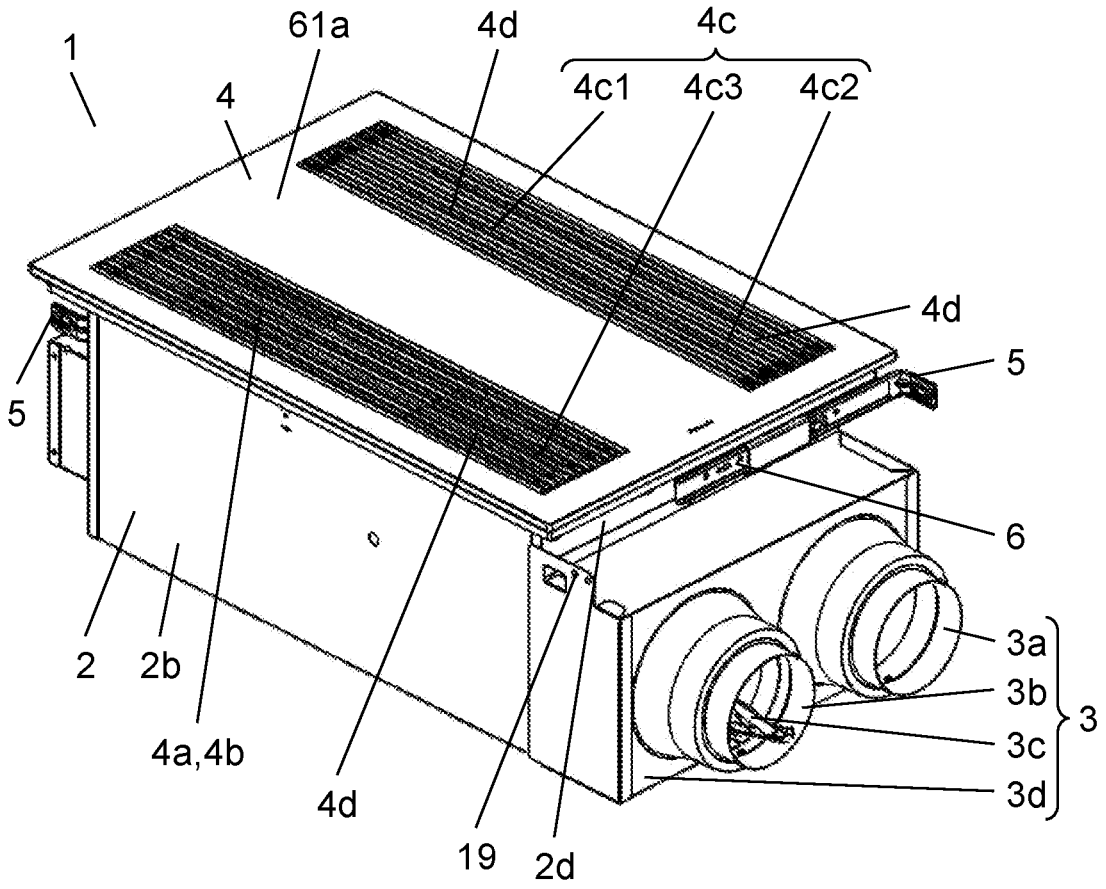
FIG. 1 is a perspective view illustrating an embedded ventilation fan according to a first exemplary embodiment.
Figure 2:
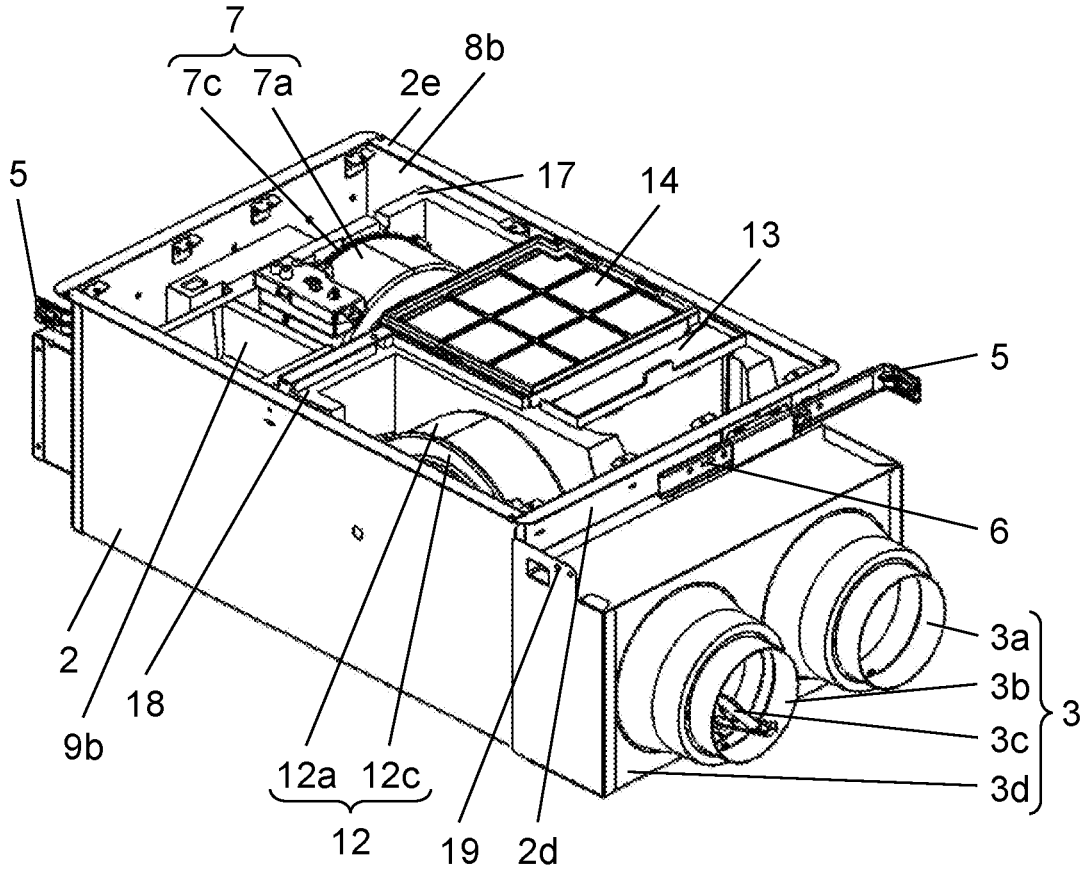
FIG. 2 is a perspective view illustrating an inside of a housing.
Figure 3:
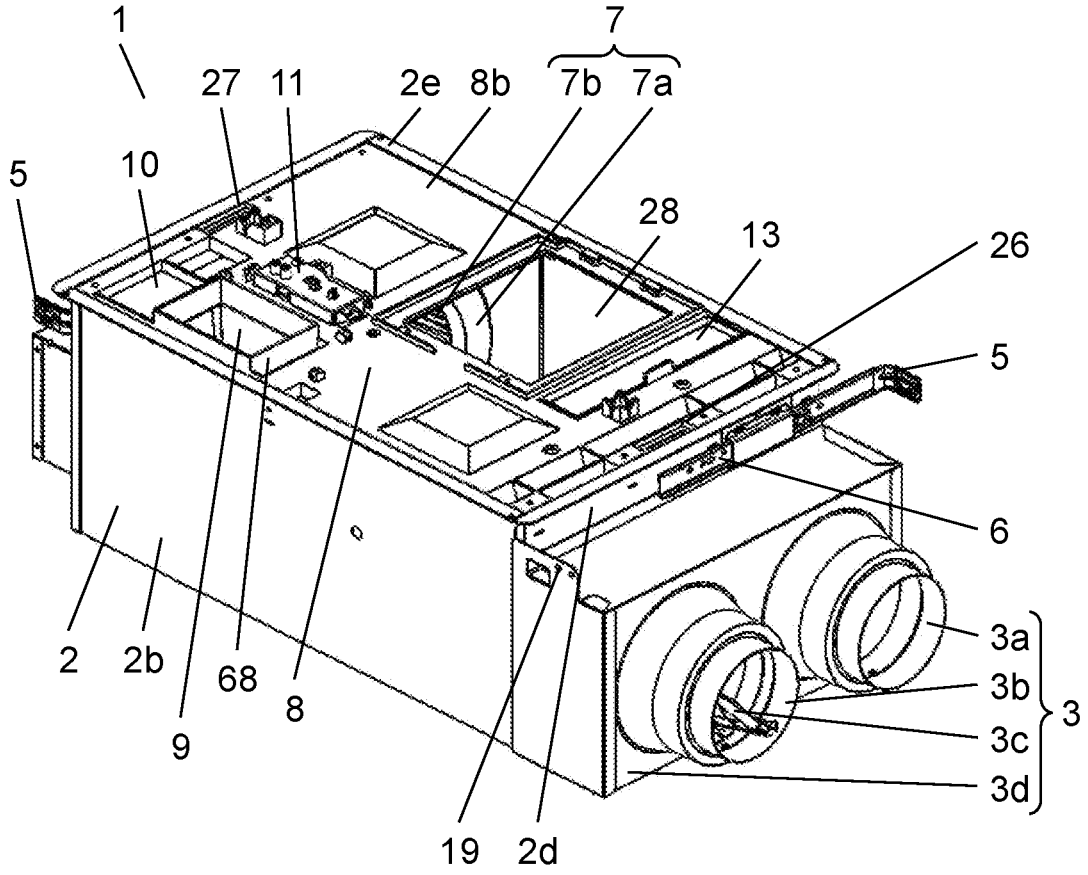
FIG. 3 is a perspective view illustrating the housing and an inner lid.

As illustrated in FIGS. 1, 2, and 3, embedded ventilation fan 1 includes housing 2, adapter set 3, and air supply blower 7.

Housing 2 has first side surface 2*a*, second side surface 2*b*, third side surface 2*c*, adapter installation surface 2*d*, lower surface 2*e*, and upper surface 2*f*, which will be described later.

Adapter set 3 includes air supply adapter 3*a*, air exhaust adapter 3*b*, air exhaust shutter 3*c*, and adapter support portion 3*d*. Adapter set 3 is provided on adapter installation surface 2*d*.

Air supply blower 7 includes air supply casing 7*a*, air supply impeller 7*b*, air supply motor support plate 7*c*, air supply motor 7*d*, and air supply rotation shaft 7*e*, which will be described later.

Decorative panel 4 is provided on lower surface 2*e* of housing 2. Decorative panel 4 has air supply slit opening 4*a*, air supply slit 4*b*, air exhaust slit openings 4*c*, and air exhaust slits 4*d*. Decorative panel 4 has front surface 61*a* facing a space of a room.

Air exhaust slit openings 4*c* include first air exhaust slit opening 4*c*1, second air exhaust slit opening 4*c*2, and third air exhaust slit opening 4*c*3.

Metal fitting 5 is a component for embeddably providing housing 2 on a building ceiling or a building wall surface.

Metal fitting guide 6 is a component for preventing metal fitting 5 from falling off from housing 2. Metal fitting guide 6 is fixed to first side surface 2*a* and adapter installation surface 2*d* by using a fixing method such as a screw.

Metal fitting 5 and metal fitting guide 6 are attached to housing 2 substantially horizontally and substantially coaxially with each other, for example. Here, the term "substantially horizontally" includes an angle inclined within ±10° from a horizontal direction. The term "substantially coaxially" also includes an angle inclined within ±10° from the same axis.

Screw hole 19 is a hole for connecting housing 2 and a beam provided on the building ceiling or the building wall surface with a screw.

Inner lid opening 8*b* is provided on lower surface 2*e* of housing 2. Inner lid 8 is provided to cover a part or the whole of inner lid opening 8*b*.

Connection member 9*b* is a member that forms an air passage near air supply blow-out port 9 of inner lid 8. Connection member 9*b* connects air supply blower 7 and air supply blow-out port 9.

Inner lid 8 has air supply blow-out port 9 and air exhaust suction port 28. Air supply blow-out port 9 is formed by, for example, a space surrounded by inner air supply blowing unit 68.

Control board 10 that controls an operation of embedded ventilation fan 1 is provided, for example, on inner lid 8.

Display unit 11 that displays a state of embedded ventilation fan 1 is provided, for example, on inner lid 8.

Inner lid 8 includes first spring engagement portion 26 and second spring engagement portion 27.

Figure 4:
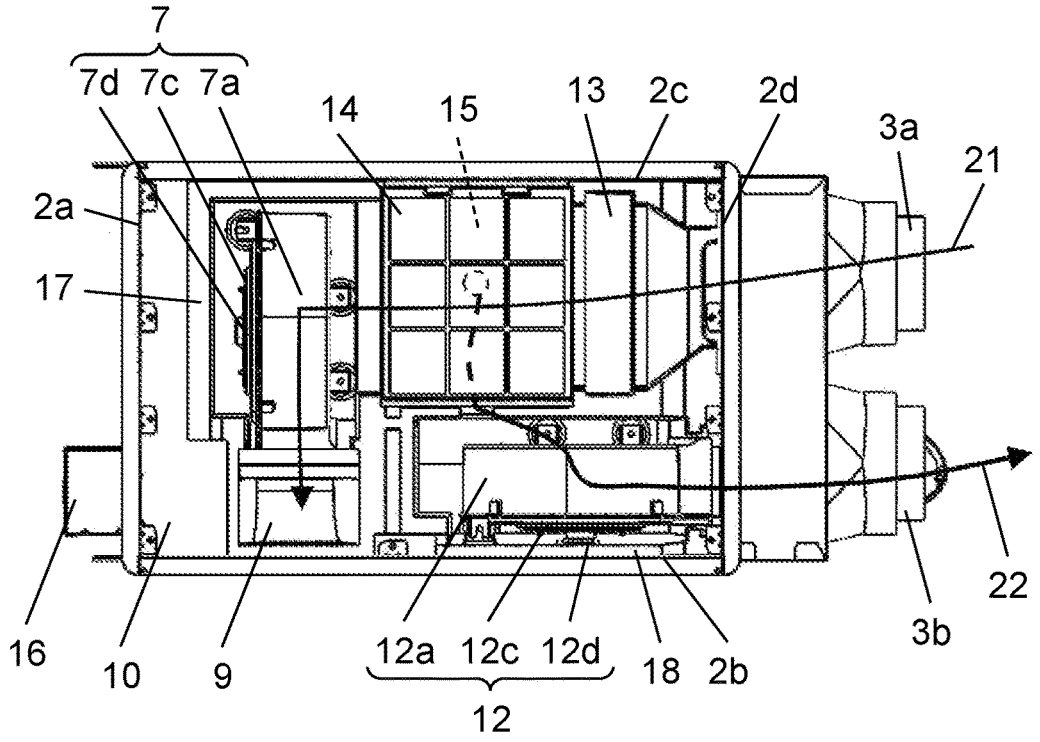
FIG. 4 is a front view of the inside of the housing as viewed from below.

As illustrated in FIG. 4, embedded ventilation fan 1 includes air exhaust blower 12. Air exhaust blower 12 includes air exhaust casing 12*a*, air exhaust impeller 12*b*, air exhaust motor support plate 12*c*, air exhaust motor 12*d*, and air exhaust rotation shaft 12*e*, which will be described later.

Air supply side heat insulating plate 17 is provided between first side surface 2*a* and air supply motor support plate 7*c*. Air supply side heat insulating plate 17 is a plate that insulates heat between air supply passage 21 and housing 2. Air supply side heat insulating plate 17 is made of, for example, expanded polystyrene having excellent heat insulating performance. A thickness of air supply side heat insulating plate 17 is preferably equal to or more than 5 mm, and more preferably equal to or more than 10 mm.

Air exhaust side heat insulating plate 18 is provided between second side surface 2*b* and air exhaust motor support plate 12*c*. Air exhaust side heat insulating plate 18 is a plate that insulates heat between air exhaust passage 22 and housing 2. When air exhaust side heat insulating plate 18 is not provided, there is a possibility that the heat of air exhaust passage 22 is transferred to the room via housing 2. Air exhaust side heat insulating plate 18 is made of, for example, expanded polystyrene having excellent heat insulating performance. A thickness of air exhaust side heat insulating plate 18 is preferably equal to or more than 5 mm, and more preferably equal to or more than 10 mm.

Air supply passage 21 through which air is blown from an outside of the room into the room by air supply blower 7 is formed.

Air exhaust passage 22 through which air is blown from an inside of the room to the outside of the room by air exhaust blower 12 is formed.

Heat exchange element 15 is provided at a position where air supply passage 21 and air exhaust passage 22 cross each other. Heat exchange element 15 is disposed, for example, between air supply blower 7 and adapter set 3. Heat exchange element 15 is provided, for example, just above or directly above air exhaust suction port 28. Heat exchange element 15 is provided, for example, between air exhaust blower 12 and third side surface 2*c*.

Air passes through air supply adapter 3*a*, air supply filter 13, heat exchange element 15, air supply blower 7, air supply blow-out port 9, and air supply slit opening 4*a* in this order in air supply passage 21.

Air passes through air exhaust slit openings 4*c*, air exhaust suction port 28, air exhaust filter 14, heat exchange element 15, air exhaust blower 12, and air exhaust adapter 3*b* in this order in air exhaust passage 22.

Figure 5:
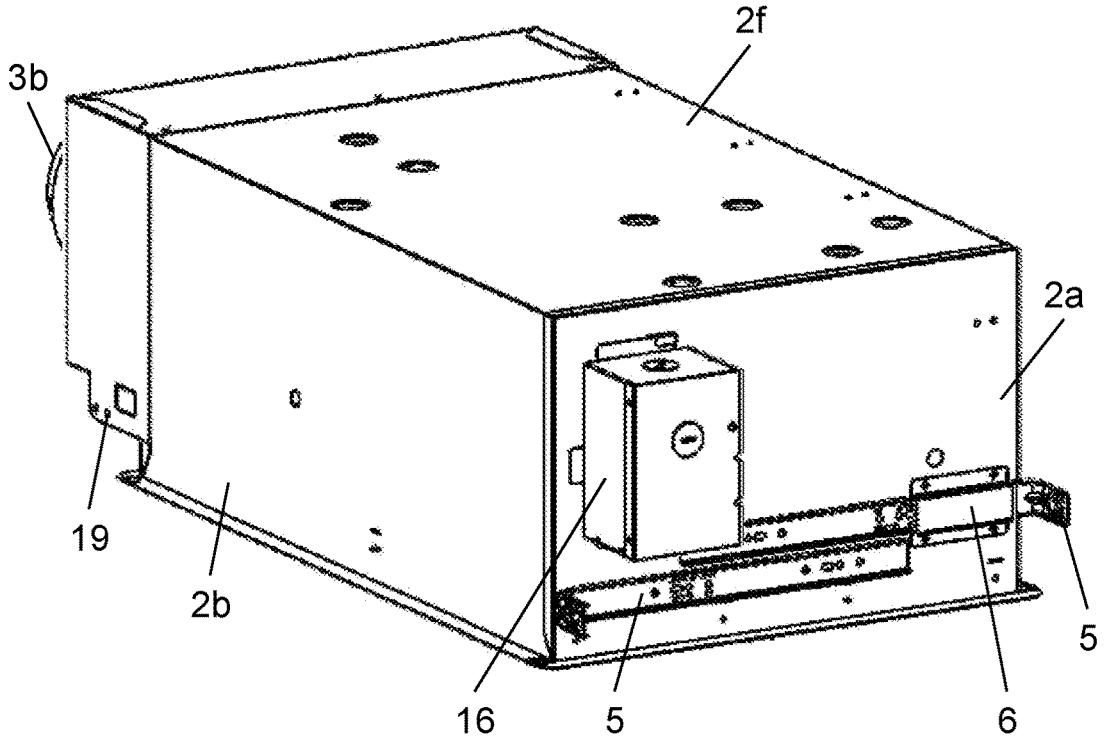
FIG. 5 is a perspective view illustrating the housing.

As illustrated in FIG. 5, a surface facing lower surface 2*e* of housing 2 is upper surface 2*f*.

Power supply connection box 16 that houses a power supply cord is provided, for example, on first side surface 2*a*. Power supply connection box 16 may be, for example, near control board 10 inside housing 2.

Figure 6:
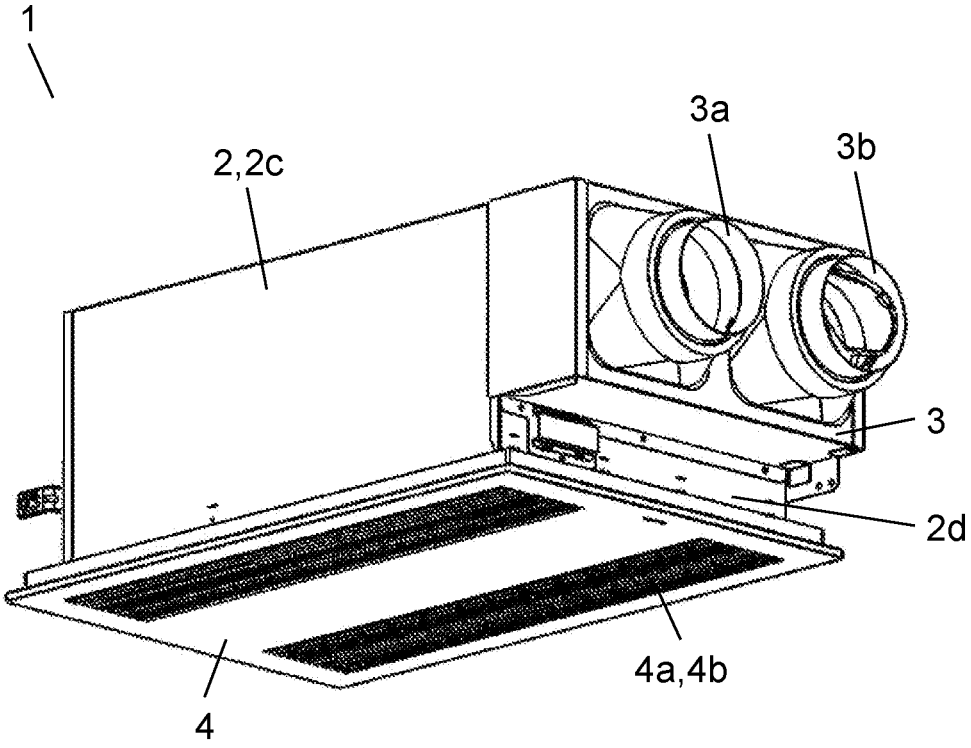
FIG. 6 is a perspective view illustrating an installation state of the embedded ventilation fan.

As illustrated in FIG. 6, housing 2 of embedded ventilation fan 1 is embedded in a wall surface of the room or the like in an orientation in which decorative panel 4 provided on lower surface 2*e* faces downward. The wall surface mainly refers to a ceiling, but also includes the side walls of the room other than the ceiling. In this case, lower surface 2*e* does not necessarily face downward. At the time of installation, decorative panel 4 is exposed from the wall surface.

In the present disclosure, the "lower surface" indicates, for example, a position where embedded ventilation fan 1 faces downward in a scene in FIG. 6. In a scene where embedded ventilation fan 1 is provided on the wall surface other than the ceiling, the "lower surface" includes a case where embedded ventilation fan 1 does not face downward (in a direction in which gravity acts). However, the "lower surface" broadly means a position corresponding to these positions. The same applies to "upper surface", "directly below", "directly above", "up direction", "down direction", and the like.

Figure 7:
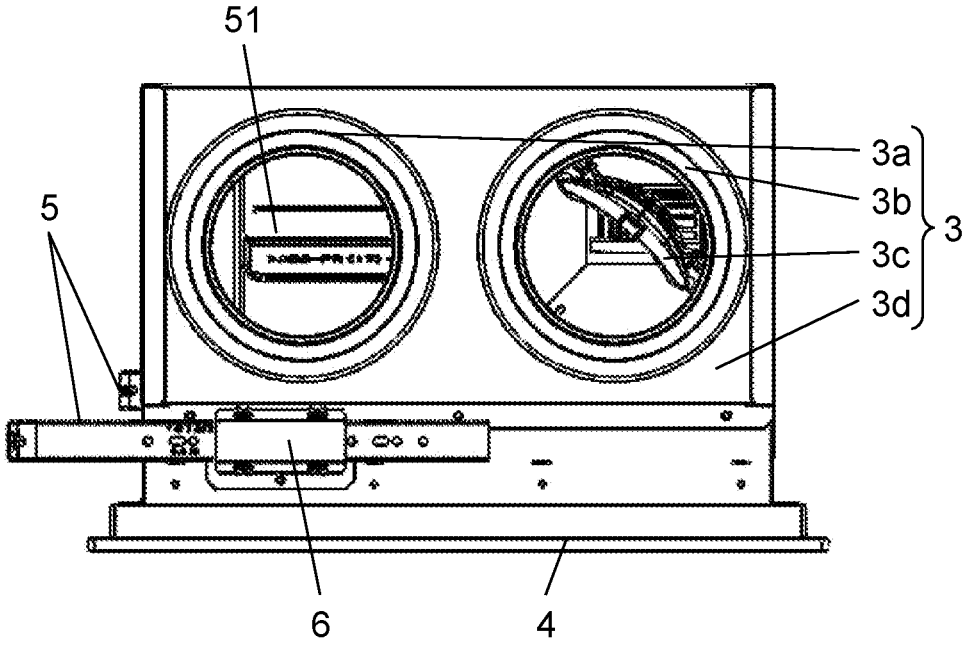
FIG. 7 is a diagram illustrating a portion near an adapter set.

As illustrated in FIG. 7, air supply damper 51 is provided near air supply adapter 3*a*.

Figure 8:
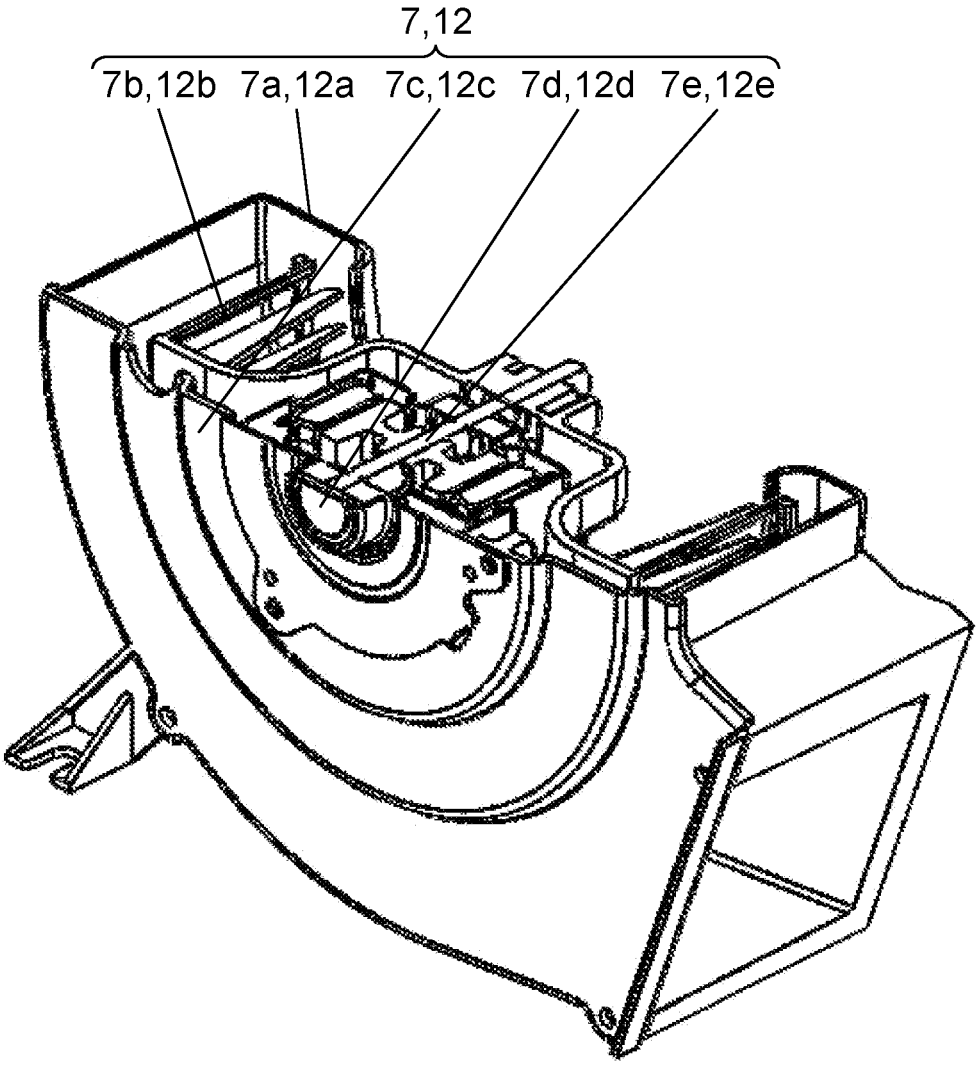
FIG. 8 is a sectional perspective view illustrating an air supply blower or an air exhaust blower.

As illustrated in FIG. 8, air supply blower 7 and air exhaust blower 12 may have similar configurations. Air supply impeller 7*b* is provided in air supply casing 7*a*. Air supply motor 7*d* is connected to air supply impeller 7*b* via air supply rotation shaft 7*e*. Air supply motor support plate 7*c* supports air supply motor 7*d*. Air supply motor support plate 7*c* faces first side surface 2*a*.

Air supply blower 7 is disposed inside housing 2 in a state where an axial direction of air supply rotation shaft 7*e* is substantially in the horizontal direction. Here, the term "substantially in the horizontal direction" includes an angle inclined within ±10° from a horizontal direction.

Air exhaust impeller 12*b* is provided in air exhaust casing 12*a*. Air exhaust motor 12*d* is connected to air exhaust impeller 12*b* via air exhaust rotation shaft 12*e*. Air exhaust motor support plate 12*c* supports air exhaust motor 12*d*. Air exhaust motor support plate 12*c* faces second side surface 2*b*.

Air exhaust blower 12 is disposed inside housing 2 in a state where an axial direction of air exhaust rotation shaft 12*e* is substantially in the horizontal direction.

Figure 9:
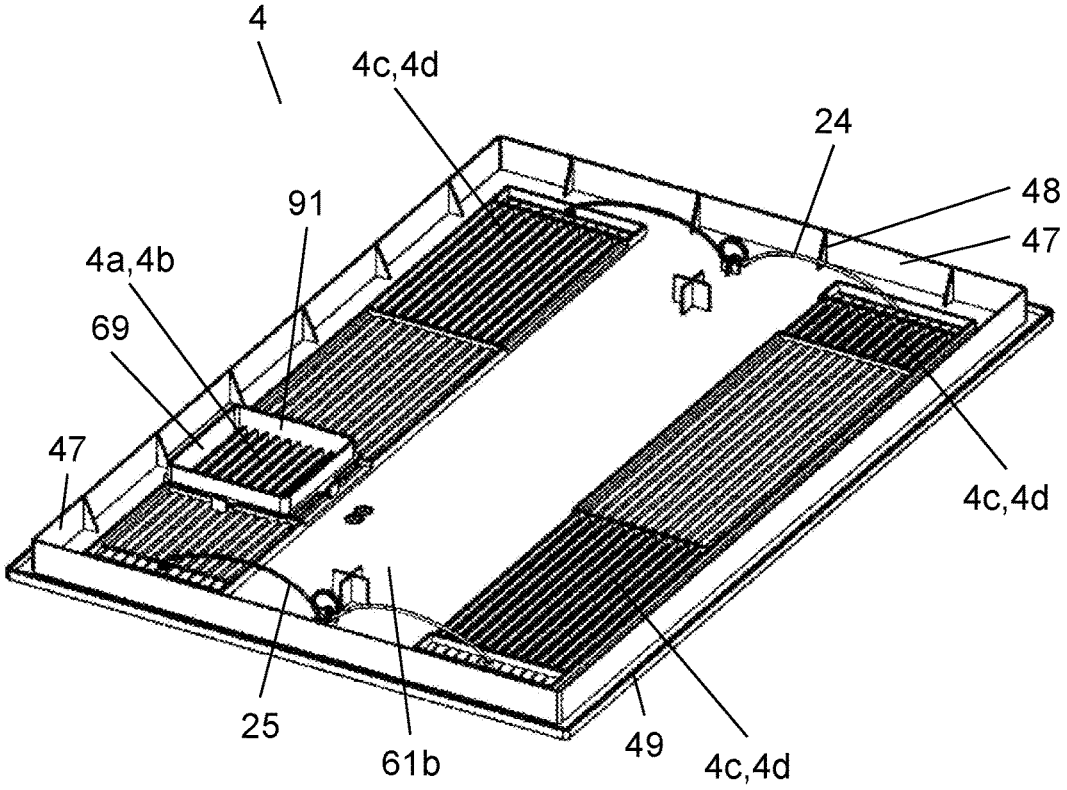
FIG. 9 is a perspective view illustrating a rear surface of a decorative panel.

As illustrated in FIG. 9, decorative panel 4 includes first spring 24 and second spring 25. First spring 24 is engaged with first spring engagement portion 26 (see FIG. 3). Second spring 25 is engaged with second spring engagement portion 27 (see FIG. 3).

Decorative panel 4 includes outer frame 47, reinforcing portion 48, and end portion 49. Outer frame 47 is an outer frame portion of decorative panel 4 on rear surface 61*b*. Reinforcing portion 48 reinforces outer frame 47. End portion 49 is a portion of an end present further outside outer frame 47.

A characteristic configuration of the present exemplary embodiment will be described.

Figure 10:
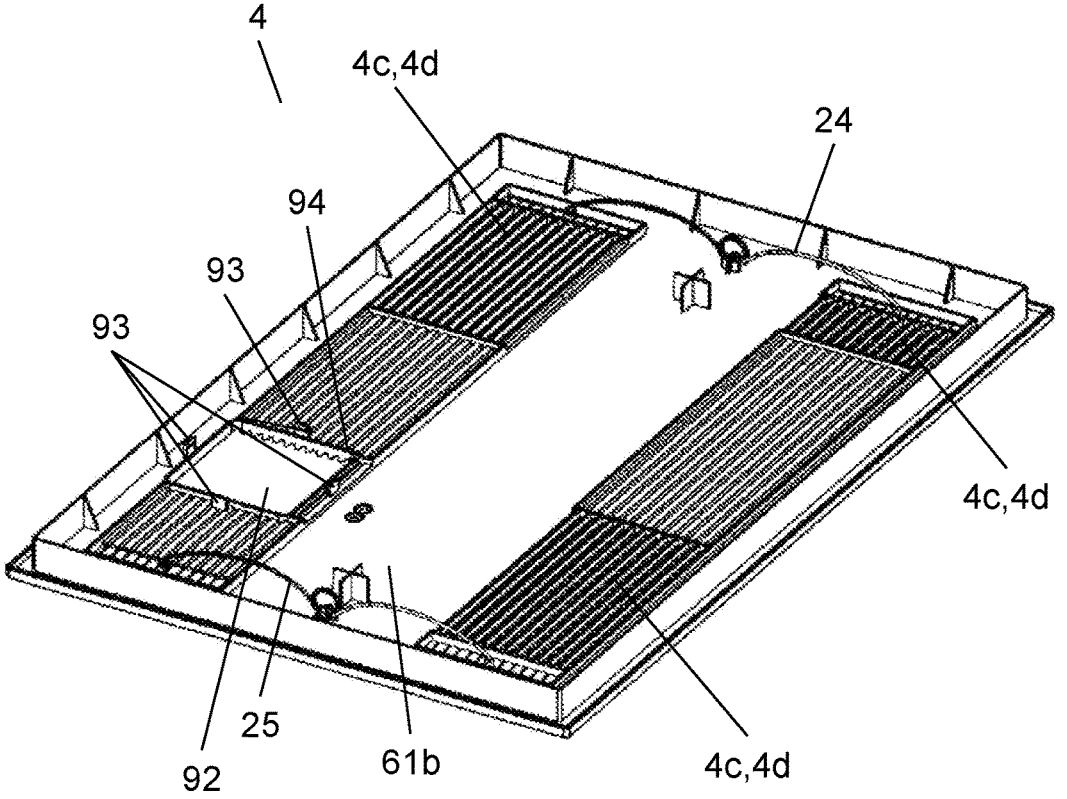
FIG. 10 is a perspective view illustrating a rear surface in a state where an air supply grille is removed from the decorative panel.

As illustrated in FIGS. 9 and 10, decorative panel 4 has rear surface 61*b*, grille opening 92, frame portion 94, and air supply grille 91. Decorative panel 4 may have claws 93.

Rear surface 61*b* is a surface opposite to front surface 61*a* (see FIG. 1).

Grille opening 92 is surrounded by frame portion 94.

Grille opening 92 is, for example, a rectangular opening.

On rear surface 61*b*, air supply grille 91 is attached to grille opening 92.

Frame portion 94 protrudes from rear surface 61*b* toward an inside of housing 2.

Claws 93 protrude from rear surface 61*b* toward the inside of housing 2.

For example, two or four claws 93 are provided for one grille opening 92.

Figure 11:
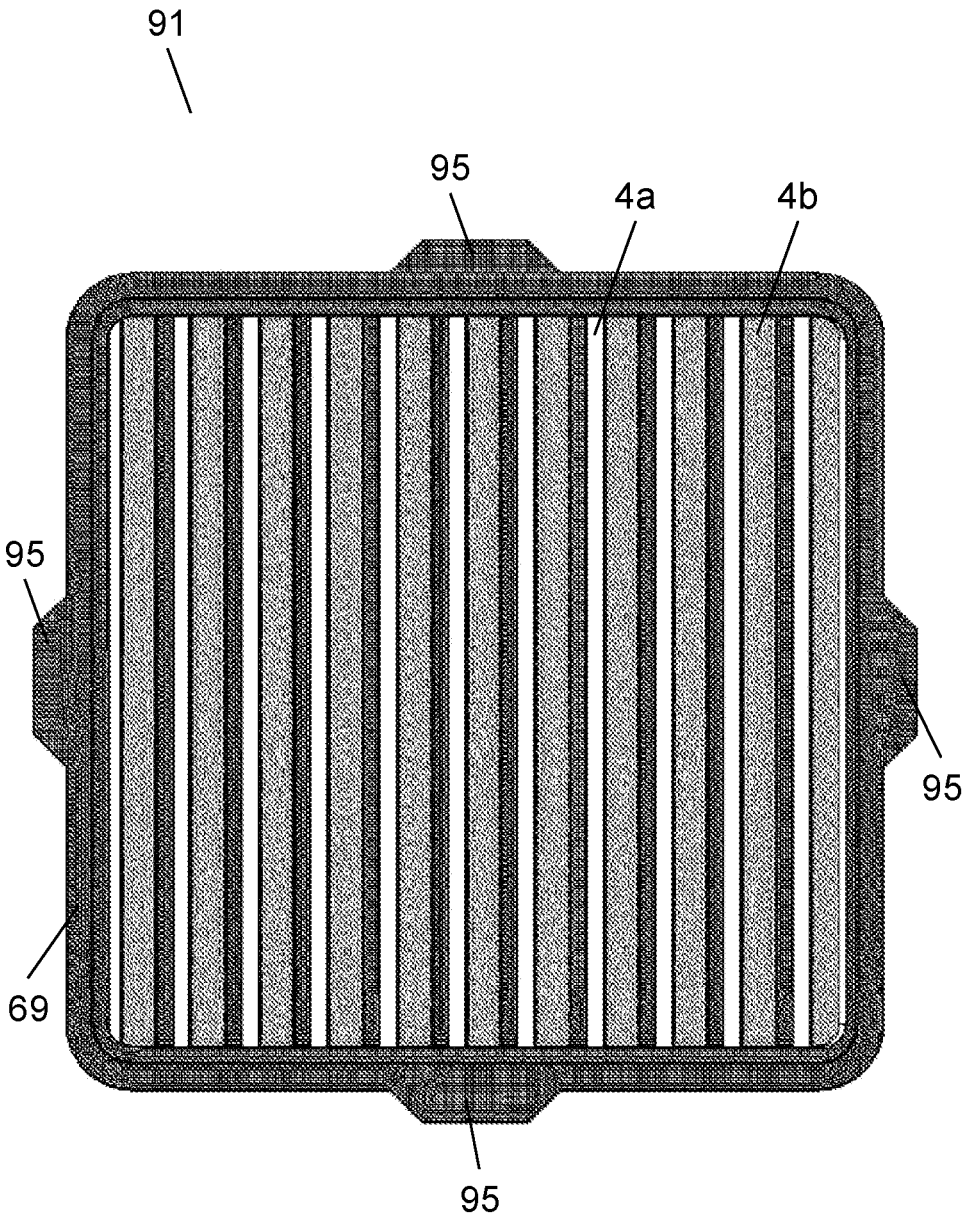
FIG. 11 is a front view illustrating the air supply grille.

As illustrated in FIG. 11, air supply grille 91 has air supply slit opening 4*a*, air supply slit 4*b*, outer air supply blowing unit 69, and contact portions 95.

Air supply grille 91 (outer air supply blowing unit 69) has, for example, a rectangular shape in front view. The rectangular shape is more preferably a shape in which lengths in a longitudinal direction and a lateral direction are equal.

Outer air supply blowing unit 69 is connected to inner air supply blowing unit 68 of FIG. 3. At the time of connection, outer air supply blowing unit 69 is located outside inner air supply blowing unit 68. As a result, leakage of air flowing through air supply passage 21 to the outside of air supply passage 21 can be suppressed.

Figure 12:
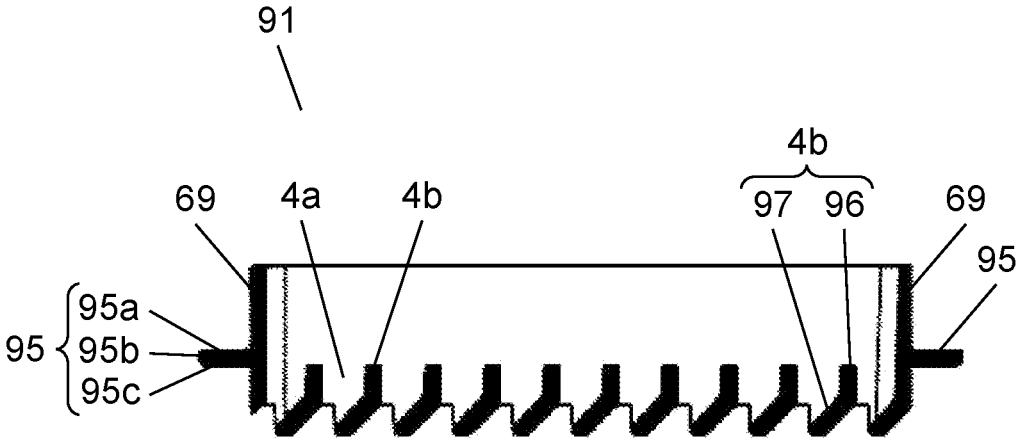
FIG. 12 is a side sectional view illustrating the air supply grille.

As illustrated in FIG. 12, contact portion 95 has upper surface 95*a*, side surface 95*b*, and lower surface 95*c*.

Air supply slit 4*b* has straight portion 96 and inclined portion 97.

Figure 13:
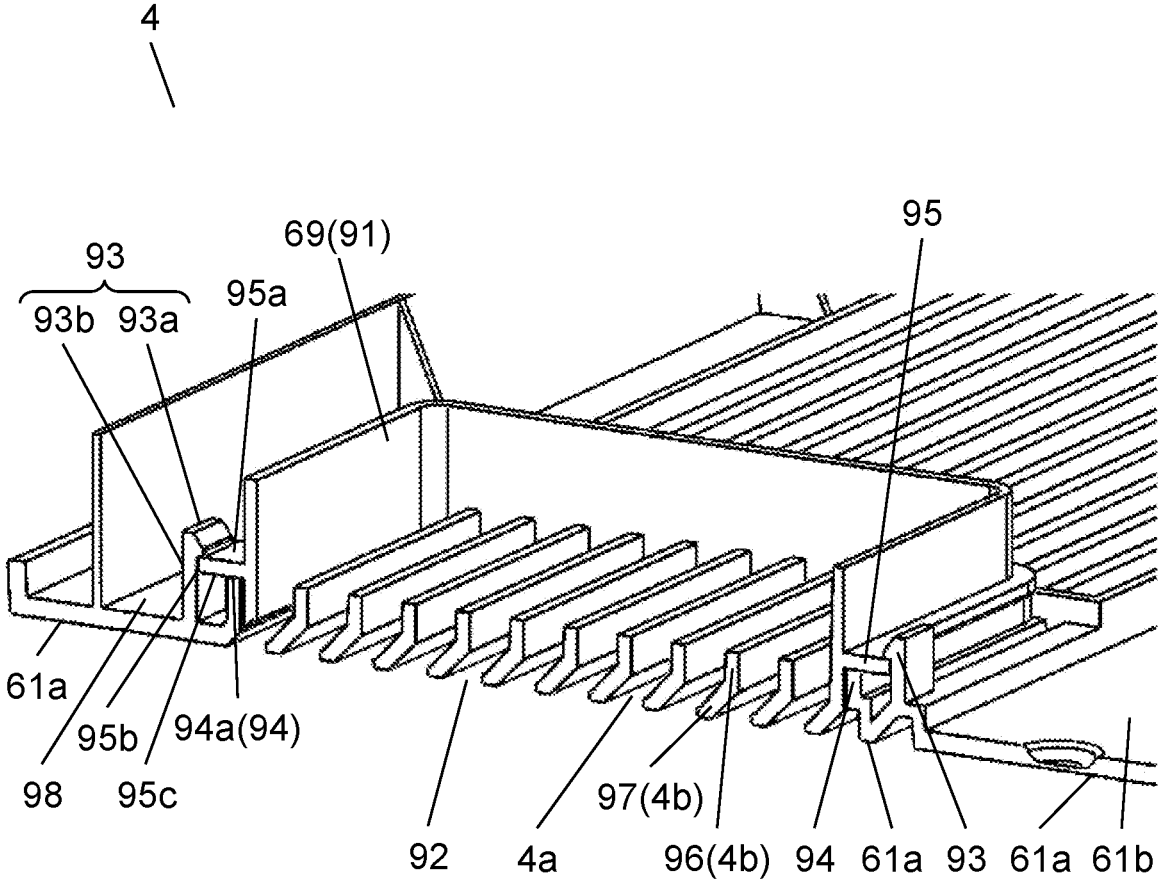
FIG. 13 is a sectional perspective view illustrating the decorative panel and the air supply grille.
Figure 14:
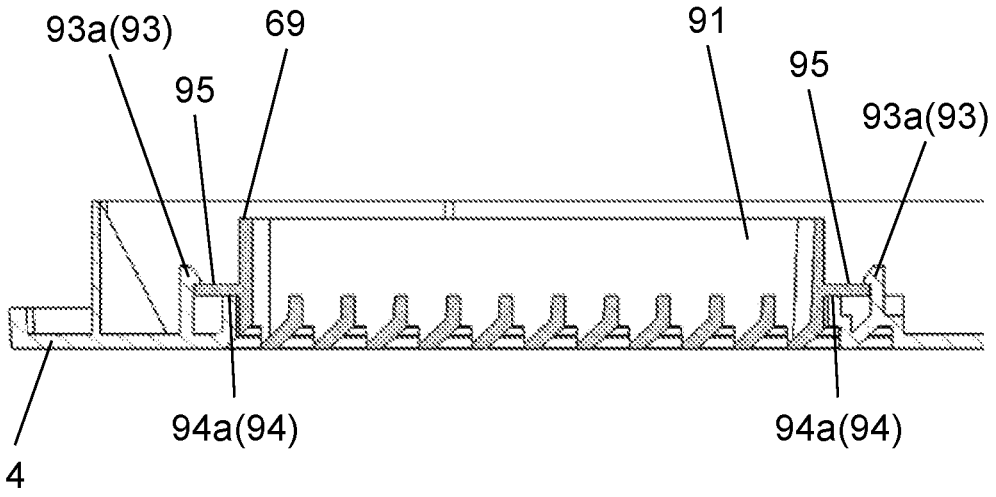
FIG. 14 is a side sectional view illustrating the decorative panel and the air supply grille.

As illustrated in FIGS. 13 and 14, claw 93 has distal end portion 93*a* and base portion 93*b*.

Frame portion 94 has upper surface 94*a*. Upper surface 94*a* refers to a surface facing the inside of housing 2.

Air supply grille 91 is attached to grille opening 92 by brining upper surface 94*a* of frame portion 94 into contact with lower surface 95*c* of contact portion 95. That is, air supply grille 91 is provided on frame portion 94. Since air supply grille 91 is larger than frame portion 94, air supply grille 91 is less likely to fall from grille opening 92.

For example, claws 93 are provided, and thus, air supply grille 91 can be stably attached to grille opening 92. At this time, upper surface 95*a* of contact portion 95 comes into contact with a distal end of distal end portion 93*a*.

Further, when the side surface of base portion 93*b* comes into contact with side surface 95*b* of contact portion 95, air supply grille 91 can be more stably attached to grille opening 92.

Hereinafter, the present exemplary embodiment will be supplemented.

Decorative panel 4 according to an aspect of the present disclosure is decorative panel 4 that includes front surface 61*a*, rear surface 61*b*, grille opening 92, frame portion 94, and air supply grille 91. Front surface 61*a* is a surface opposite to rear surface 61*b*, and grille opening 92 is surrounded by frame portion 94. Air supply grille 91 has air supply slit 4*b*, air supply slit opening 4*a*, outer air supply blowing unit 69, and contact portion 95. Air supply grille 91 is detachably provided in grille opening 92, and air supply slit 4*b* forms air supply slit opening 4*a*. Air is supplied from rear surface 61*b* side to front surface 61*a* side through air supply slit opening 4*a*, outer air supply blowing unit 69 forms a passage of the air supplied from air supply slit opening 4*a*, and contact portion 95 is connected to outer air supply blowing unit 69. When front surface 61*a* side is defined as the down direction and rear surface 61*b* side is defined as the up direction, air supply grille 91 is attached to grille opening 92 by bringing upper surface 94*a* of frame portion 94 into contact with lower surface 95*c* of contact portion 95.

According to this configuration, it is possible to provide decorative panel 4 in which the falling of air supply grille 91 from grille opening 92 is suppressed.

In addition, decorative panel 4 may include claws 93, claw 93 may have distal end portion 93*a* and base portion 93*b*, base portion 93*b* may protrude from base 98 of rear surface 61*b* in the up direction, distal end portion 93*a* may be connected to base portion 93*b*, and air supply grille 91 may be fixed to grille opening 92 by bringing the distal end of distal end portion 93*a* into contact with upper surface 95*a* of contact portion 95.

According to this configuration, contact portion 95 can be fixed to claws 93. In addition, claws 93 are operated, and thus, the fixing of contact portion 95 by claws 93 can be released.

In addition, the side surface of base portion 93*b* may come into contact with side surface 95*b* of contact portion 95.

According to this configuration, air supply grille 91 can be more stably fixed to claws 93.

In addition, air supply slit 4*b* may have straight portion 96 and inclined portion 97, and inclined portion 97 inclined with respect to straight portion 96 may be connected to straight portion 96.

According to this configuration, the air passing through air supply slit opening 4*a* is blown into an indoor in a state of having an angle formed by inclined portion 97. Thus, it is possible to suppress generation of an excessively strong airflow directly below air supply grille 91. As a result, it is possible to prevent a user from feeling excessive cold air or hot air.

In addition, the air supply grille can be attached to the grille opening by being rotated by 90° around a direction perpendicular to rear surface 61*b* as a rotation axis.

According to this configuration, the air having the angle formed by inclined portion 97 can be freely changed in four directions. Specifically, when front surface 61*a* is viewed from the front, one direction of the air passing through air supply slit opening 4*a* can be selected from the four directions. These four directions are different by 90°. Thus, even though an attachment position or an attachment direction of decorative panel 4 in the room are changed, the direction of the supplied air can be changed in accordance with the change of the attachment position or the attachment direction of decorative panel 4.

In addition, embedded ventilation fan 1 that includes decorative panel 4 may include housing 2, air supply blower 7, and inner lid 8. Housing 2 may have side surfaces (first side surface 2*a*, second side surface 2*b*, third side surface 2*c*, and adapter installation surface 2*d*), upper surface 2*f*, and lower surface 2*e*. Decorative panel 4 may be provided on lower surface 2*e*, air supply passage 21 through which air is blown from an outside of a room into the room by air supply blower 7 may be formed, and air supply slit opening 4*a* may be connected to air supply passage 21. Housing 2 may have inner lid opening 8*b* on lower surface 2*e*, and inner lid 8 may be provided to cover inner lid opening 8*b*. Inner lid 8 may be positioned between housing 2 and decorative panel 4, and inner lid 8 may have air supply blow-out port 9 and inner air supply blowing unit 68. Air supply blow-out port 9 may be surrounded by inner air supply blowing unit 68, and air supply blow-out port 9 may be connected to air supply passage 21. Outer air supply blowing unit 69 may be connected to inner air supply blowing unit 68 to be outside of inner air supply blowing unit 68.

According to this configuration, it is possible to suppress leaking of the air flowing through air supply passage 21 out of air supply passage 21 before passing through air supply slit opening 4*a*.

In addition, although inner lid 8 is provided on lower surface 2*e* of housing 2 as a separate member from housing 2, inner lid 8 may have another configuration. For example, inner lid 8 may be provided on lower surface 2*e* integrally with housing 2.

In addition, air supply blower 7 and/or air exhaust blower 12 may be provided outside housing 2. This is because air supply passage 21 and/or air exhaust passage 22 can be formed even though air supply blower 7 and/or air exhaust blower 12 are outside housing 2.

Although the embedded ventilation fan according to the present disclosure has been described based on the first exemplary embodiment, the present disclosure is not limited to the first exemplary embodiment. Configurations in which various variations conceived by those skilled in the art are applied to the first exemplary embodiments, and configurations established by combining components of different exemplary embodiments also fall within the scope of the present disclosure without departing from the gist of the present disclosure.

The embedded ventilation fan according to the present disclosure is useful as an embedded ventilation fan embedded in a wall surface such as a ceiling, a heat exchange ventilation device, or the like.

What is claimed is:

1. A decorative panel comprising:
a front surface;
a rear surface;
a grille opening;
a claw;
a frame portion; and
an air supply grille, wherein
the front surface is a surface opposite to the rear surface,
the grille opening is surrounded by the frame portion,
the air supply grille includes an air supply slit, an air supply slit opening, an outer air supply blowing unit, and a contact portion,
the air supply grille is detachably provided in the grille opening,
the air supply slit forms the air supply slit opening,
air is supplied from a rear surface side to a front surface side through the air supply slit opening,
the outer air supply blowing unit forms a passage of the air supplied from the air supply slit opening,
the contact portion is connected to the outer air supply blowing unit,
when the front surface side is defined as a down direction and the rear surface side is defined as an up direction, the air supply grille is attached to the grille opening by bringing an upper surface of the frame portion into contact with a lower surface of the contact portion,
the claw includes a distal end portion and a base portion,
the base portion protrudes from a base of the rear surface in the up direction,
the distal end portion is connected to the base portion, and
the air supply grille is fixed to the grille opening by bringing a distal end of the distal end portion to an upper surface of the contact portion.

2. The decorative panel according to claim 1, wherein a side surface of the base portion comes into contact with a side surface of the contact portion.

3. The decorative panel according to claim 1, wherein
the air supply slit includes a straight portion and an inclined portion, and
the inclined portion inclined with the straight portion is connected to the straight portion.

4. The decorative panel according to claim 3, wherein the air supply grille is attachable to the grille opening by being rotated around a direction perpendicular to the rear surface by 90°.

5. An embedded ventilation fan comprising:
a decorative panel;
a housing;
an air supply blower; and
an inner lid, wherein
the decorative panel includes:
a front surface;
a rear surface;
a grille opening;
a frame portion; and
an air supply grille,
the front surface is a surface opposite to the rear surface,
the grille opening is surrounded by the frame portion,
the air supply grille includes an air supply slit, an air supply slit opening, an outer air supply blowing unit, and a contact portion,
the air supply grille is detachably provided in the grille opening,
the air supply slit forms the air supply slit opening,
air is supplied from a rear surface side to a front surface side through the air supply slit opening,
the outer air supply blowing unit forms a passage of the air supplied from the air supply slit opening,
the contact portion is connected to the outer air supply blowing unit,
when the front surface side is defined as a down direction and the rear surface side is defined as an up direction, the air supply grille is attached to the grille opening by bringing an upper surface of the frame portion into contact with a lower surface of the contact portion,
the housing includes a side surface, an upper surface, and a lower surface,
the decorative panel is provided on the lower surface,
an air supply passage through which air is blown from an outside of a room into the room by the air supply blower is provided,
the air supply slit opening is connected to the air supply passage,
the housing includes an inner lid opening on the lower surface,
the inner lid is provided to cover the inner lid opening,
the inner lid is positioned between the housing and the decorative panel,
the inner lid includes an air supply blow-out port and an inner air supply blowing unit,
the air supply blow-out port is surrounded by the inner air supply blowing unit,
the air supply blow-out port is connected to the air supply passage, and
the outer air supply blowing unit is connected to the inner air supply blowing unit to be outside of the inner air supply blowing unit.

* * * * *